US007215910B2

(12) United States Patent
Landa et al.

(10) Patent No.: US 7,215,910 B2
(45) Date of Patent: May 8, 2007

(54) COATING ESPECIALLY FOR LIQUID TONER IMAGING SYSTEM COMPONENTS

(75) Inventors: Benzion Landa, Nes-Ziona (IL); Erez Faraggi, Tel-Aviv (IL); Marc Aronhime, Rehovot (IL); Yaacov Almog, Nes-Ziona (IL); Ilya Taraniuk, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 94 days.

(21) Appl. No.: 10/485,850

(22) PCT Filed: Aug. 30, 2001

(86) PCT No.: PCT/IL01/00819

§ 371 (c)(1),
(2), (4) Date: Feb. 3, 2004

(87) PCT Pub. No.: WO03/014835

PCT Pub. Date: Feb. 20, 2003

(65) Prior Publication Data

US 2004/0175206 A1 Sep. 9, 2004

(30) Foreign Application Priority Data

Aug. 8, 2001 (WO) ..... PCT/IL01/00735

(51) Int. Cl.
*G03G 15/10* (2006.01)

(52) U.S. Cl. ..... 399/237

(58) Field of Classification Search ..... 399/239, 399/237

See application file for complete search history.

(56) References Cited

U.S. PATENT DOCUMENTS

| | | | | |
|---|---|---|---|---|
| 3,994,257 | A | 11/1976 | Komori et al. | |
| 4,107,055 | A * | 8/1978 | Sukornick et al. | 428/96 |
| 4,627,999 | A * | 12/1986 | Hsu | 428/326 |
| 6,242,527 | B1 * | 6/2001 | Mazur | 524/559 |
| 6,455,142 | B1 * | 9/2002 | Heberger et al. | 428/215 |

FOREIGN PATENT DOCUMENTS

| | | |
|---|---|---|
| WO | WO 90/05941 | 5/1990 |
| WO | WO 00/32696 | 6/2000 |

OTHER PUBLICATIONS

Kamimura, Ginko; JP 05-125570; May 21, 1993 & Patent Abstracts of Japan; vol. 017, No. 92; Sep. 7, 1993.

* cited by examiner

*Primary Examiner*—Christopher W. Fulton

(57) ABSTRACT

A liquid toner imaging system having at least one metal product, having a coating on at least a portion thereof, the coating having a thickness of between about 0.1 and about 2 microns thereon, said coating comprising an anionic fluorosurfactant, said coating being in contact with liquid toner therein.

29 Claims, 1 Drawing Sheet

COATING ESPECIALLY FOR LIQUID TONER IMAGING SYSTEM COMPONENTS

RELATED APPLICATIONS

The present application is a U.S. national application of PCT Application No. PCT/IL01/00819, filed on Aug. 30, 2001.

FIELD OF THE INVENTION

The present invention is related to the field of liquid toner imaging systems and in particular to the coating of various parts of the system to avoid sludge.

BACKGROUND OF THE INVENTION

Coating of parts of a liquid toner imaging system in order to avoid agglomerations of toner particles, colloquially known as "sludge", is well known. In general, such coatings comprise silicone or fluorosilicone materials. Surfaces normally treated include surfaces to which the toner would normally plate due to an electric field, metal surfaces on which the toner sits for extended periods of time or in regions in which the toner is subjected to other types of stress.

In WO 90/05941, the disclosure of which is incorporated herein by reference, coating of surfaces onto which toner particles would plate, due to an electric field, is described. The coatings described include fluorosilicones and ZONYL a brand name for a series of Dupont fluorosurfactants. The ZONYL material is described (incorrectly) as a fluorosilicone. With respect to the use of ZONYL as a coating the reference states "Alternatively, coating the developer electrode with fluorosilicone surfactants such as ZONYL (DuPont) has been effective in inhibiting plating out of toner particles, but this expedient inhibits plating-out of toner particles for only a limited period of time."

SUMMARY OF THE INVENTION

A general aspect of some embodiments of the invention is concerned with the use of fluorosurfactants having anionic groups as coating materials.

In an exemplary embodiment of the invention, such materials are coated onto surfaces that are to be protected from sludge formation, for example metal and especially aluminium parts. One method of coating is to dip the part to be protected from sludge into the surfactant and to allow the coating to surfactant to dry. Surprisingly, it has been found that not only does the material remain on the metal substantially permanently, but also that it is effective for protecting against the formation of sludge.

The formation of sludge, once thought to occur only where the toner was subject to plating or other stress, has been found to also be formed on surfaces which are not subject to an electric field or other stress and to which the liquid toner is periodically applied (as for example, when the imager is operating). It is believed that small amounts of the toner is left on the surfaces and on drying, attaches itself to the surface forming a focus for the formation of sludge on subsequent wettings of the surface with liquid toner This effect may be enhanced when the liquid toner comprises particles formed with fibrous extensions.

There is thus provided, in accordance with an exemplary embodiment of the invention, a metal product having a coating on at least a portion thereof, the coating having a thickness of between about 0.1 and about 2 microns thereon, said coating comprising an anionic fluorosurfactant Optionally, the coating comprises more than 50% by weight of said surfactant.

There is further provided, in accordance with an embodiment of the invention, a metal product having a coating thereon said coating comprising an anionic fluorosurfactant in an amount greater than 50% by weight.

Optionally, the fluorosurfactant includes chemical anchors to bond it to the metal surface.

There is further provided, in accordance with an embodiment of the invention, a metal product coated with a fluorosurfactant having chemical anchors to bond it to the metal surface.

Optionally, the coating comprises more than 80%, 90%, 95% or 99% by weight of said surfactant.

In an embodiment of the invention, the surfactant comprises a material having the formulation: $(RfCH_2CH_2O)_xP(O)(OH)_y$, where $Rf=F(CF_2CF_2)_z$; x=1 or 2; y=2 or 1; x+y=3; z=1 to about 7.

Alternatively or additionally, the surfactant comprises a material having the formulation: $RfCH_2CH_2SCH_2CH_2CO_2Li$, where $Rf=F(CF_2CF_2)_x$ and x=1 to about 9.

Alternatively or additionally, the surfactant comprises a material having the formulation: $(RfCH_2CH_2O)_xPO(ONH_4)_y$, where $Rf=F(CF_2CF_2)_z$; x=1 or 2; y=2 or 1; x+y=3 and z=1 to about 7.

Alternatively or additionally, the surfactant comprises a material having the formulation: $(RfCH_2CH_2O)_xPO(ONH_4)_y$ where $Rf=F(CF_2CF_2)_z$ where x=1 or 2; y=2 or 1; and z=1 to about 7; x+y=3.

Optionally, the metal is aluminum.

Optionally, the thickness is greater than about 0.3 or 0.5 micrometers. Optionally, the thickness is less than about 1 micrometer.

There is further provided, a liquid toner imaging system having at least one metal product, according to the above description, said coating being in contact with liquid toner therein.

Optionally, the metal product includes at least one surface that is not in continuous contact with the liquid toner Optionally, the metal product has at least one surface in contact with liquid toner that is not subject to an electric field that would tend to plate toner particles onto the surface. Optionally, none of the coated surfaces of the metal product that are in contact with liquid toner are subjected to an electric field that would tend to plate toner particles onto the surface. Optionally, none of the coated surfaces that are in contact with liquid toner are subjected to any substantial electric field.

BRIEF DESCRIPTION OF THE DRAWING

Exemplary, non-limiting embodiments of the invention are described with reference to the following drawing.

DESCRIPTION OF EXEMPLARY EMBODIMENTS

Figure 1:
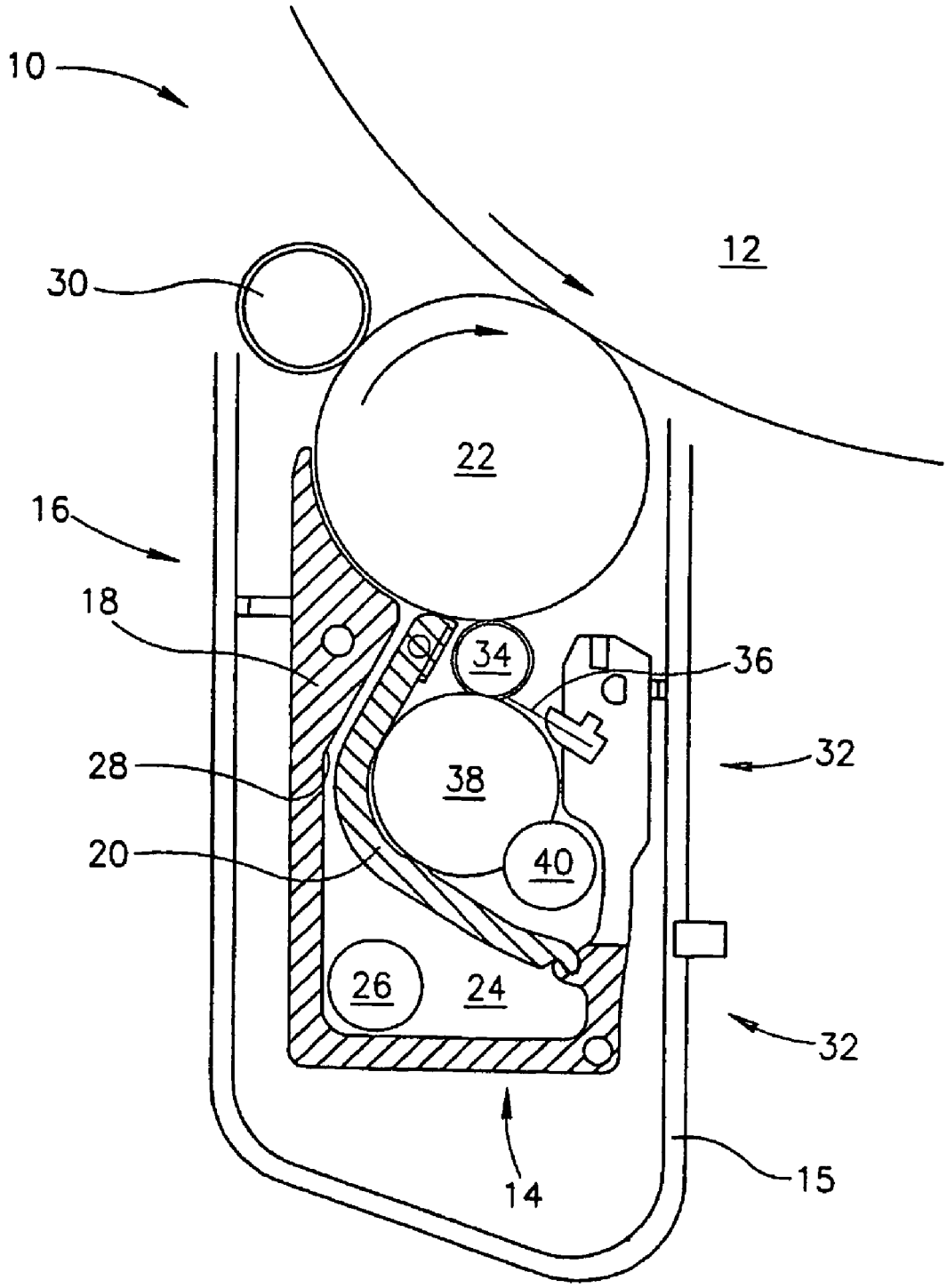
FIG. 1 is a schematic cross-sectional view of part of an imaging system in which the present invention has been tested.

FIG. 1 shows a cross-sectional view of a development system 10 in which the formation of sludge was unexpectedly encountered. Similar systems have been described in the past in patents and patent applications of the assignee of the present application. It should be noted that the particular device chosen does not form a part of the present invention and is described here for reference purposes only to illustrate a use of the invention.

A latent image is formed on an imaging surface such as a photoreceptor 12, by means that are not shown. Many methods of forming such latent images are well known in the art and the latent image can be temporary (as when an organic or selenium based photoreceptor is used) or can be permanent.

A developer apparatus 14 is used to develop the latent image with a liquid toner to form a developed image on imaging surface 12 for subsequent transfer to a substrate such as paper or plastic (not shown).

The exemplary development system shown is encased in a housing 15. An electrode 16 is formed in two parts, a main electrode 18 and a back electrode 20. Both the main and back electrodes are operatively associated with a developer electrode 22, shown in the form of a developer roller. Electrode 16 is formed with a cavity 24 into which liquid toner is introduced via a toner input portal 26. The liquid toner is forced by pressure via a passage 28 to enter narrow spaces between electrodes 18 and 20 and developer electrode 22. Main and back electrodes 18 and 20, on the one hand and developer electrode 22 on the other hand are electrified to different voltages, so that the charge toner particles are plated onto the developer electrode, providing a thin concentrated layer of toner particles. A, preferably electrified, squeegee roller 30 removes liquid from the plated concentrated developer to form a more concentrated layer. The layer is imagewise transferred to those portions of the latent image that are electrified to attract it, with developer roller preferably being electrified to aid in the transfer of the layer to image areas of the latent image and to prevent transfer to background areas of the latent image. All or a part of the thickness of the layer may be transferred, as known in the art.

A cleaning system 32, comprising, in the exemplary embodiment shown, a cleaning roller 34, a scraper 36 a sponge roller 38 and a squeezing roller 40, is used to remove the layer (or portions of a layer) that remain on the developer roller. This material can be stored in the space 42 between electrode 16 and housing 15, or it may be removed from the housing for reuse.

Sludge is believed to form at surfaces at which plating of the toner can take place and also in areas in which toner is left in contact with a metal surface, at which the toner particles can be discharged and aglomerate.

It should be understood that, utilizing prior art thinking, no sludge should form in the liquid toner path prior to the developer roller, since toner is not subject to any electrical stresses in this region and since the toner drains from space 24 when the imaging system is idle. This region is not subject to an electric field, except for the fields between electrode 16 and roller electrode 22 and the field between roller electrode 22 and squeegee roller 30. However, these fields cause plating onto the developer roller and thus should not cause sludge in the system.

Nevertheless, sludge has been found to form in this system. While the cause of the sludge is not completely understood, its formation is believed to take place in passage 28 which is has a gap of only 1.5 mm. However, it may be that the sludge forms in other areas.

Attempts were made to stop the sludge formation, by plating the surfaces of electrode 18 with fluorosilicones. However, these attempts were only partially successful. Applicants discovered that some fluorosurfactants were more effective than fluorosilicones, while others either did not adhere to the surfaces for extended periods of time or were not overly effective in reducing the formation of sludge, anionic fluorosurfactants worked best. All of the anionic fluorosurfactants were effective, with some of them performing better at sludge reduction than fluorosilicone, the coating material previously thought to perform best.

In exemplary embodiments of the invention, the following fluorosurfactants gave the best results:

A ZONYL® UR, made by DuPont and comprising a surfactant of the form $(RfCH_2CH_2O)_xP(O)(OH)_y$, where $Rf=F(CF_2CF_2)_z$; x=1 or 2; y=2 or 1; x+y=3; z=1 to about 7.

B ZONYL® FSA, made by DuPont and comprising a surfactant of the form $RfCH_2CH_2SCH_2CH_2CO_2Li$, where $Rf=F(CF_2CF_2)_x$ and x=1 to about 9.

C ZONYL® FSP, made by DuPont and comprising a surfactant of the form $(RfCH_2CH_2O)_xPO(ONH_4)_y$, where $RF=F(CF_2CF_2)_z$; x=1 or 2; y=2 or 1; x+y=3 and z=1 to about 7.

D. ZONYL® FSE, made by DuPont and comprising a surfactant of the form $(RfCH_2CH_2O)_xPO(ONH_4)_y$ where $RF=F(CF_2CF_2)_z$ where x=1 or 2; y=2 or 1; and z=1 to about 7; x+y=3.

Other anionic ZONYLs were not tested. In preliminary testing ionic ZONYLs were found not to have the same effect as the anionic ZONYLs. Ionic ZONYLs were found to decay relatively quickly with time (as indicated in the above referenced WO 90/05941), and therefore they do not exhibit the sustainable prevention of sludge which has been surprisingly found for the anionic species.

In a first example of the use of the fluorosurfactant coating, ZONYL® UR is dissolved in warm (40° C.) isopropyl alcohol to form a 2% solids solution. The solution is stirred, for example, with a magnetic stirrer for 30 minutes and then cooled to room temperature and filtered. The part is then coated either by dip coating or spray coating.

In the dip coating method, the part is cleaned and then immersed in the solution, at room temperature, for 1 minute. The part was then removed from the solution at a constant speed, to aid in the formation of a uniform layer. The part is air dried for 15 minutes at room temperature. It is believed that during the immersion, the fluorosurfactant bonds to the metal electrodes to form a (calculated) thickness (after drying) of 0.05–0.1 micron layer of dry surfactant.

In the spray coating method, the part is cleaned and the solution is sprayed at the part from a distance large enough so that the spray is uniform over the part, for instance 15 cm. The spraying operation is from top to bottom and the part is dried for two minutes. The part is then sprayed from bottom to top at a somewhat larger distance (20 cm) from bottom to top. This process results in a uniform layer of dried material. The part is dried for 30 minutes at room temperature. The dry coating layer thickness is between 0.05 and 0.1 microns thick.

In a second example, ZONYL® FSP is diluted with isopropyl alcohol to form a 1% solids solution. The solution is stirred, for example, with a magnetic stirrer for 30 minutes and then cooled to room temperature and filtered. Coating is performed in either the dip or spray methods described for the first example.

D. In addition, the generic terminology for the trademarked ZONYL product appears on page 1, line 15, the first occurrence of this item which states that ZONYL is a fluorosurfactant.

Utilizing either method, the coating is believed to have more than 50% by weight of surfactant material and may have 80, 90 or even 99% or more by weight of the surfactant.

While the layer in the above examples is between 0.05 and 0.1 micrometers thick, other thicknesses, such as 0.1 to 1 or 2 micrometers are believed to work equally well. Intermediate, thicker or even thinner layers may also work well.

While not wanting to be bound to any particular theory applicants believe that the anionic fluorosurfactants achieve lasting prevention of sludge while the ionic surfactants do not for one or both of the following reasons:

1—The anions form a chemical anchor to the metal surface, which is generally aluminum.

2—The anions develop a repelling anionic surface on top of the aluminum surface. It should be understood that the toner is generally charged to a negative voltage.

While single surfactants have been used in the above examples, mixtures of suitable surfactants are also believed to be useful in the practice of the present invention.

The present invention has been described using non-limiting detailed descriptions of exemplary embodiments thereof that are provided by way of example and that are not intended to limit the scope of the invention. Variations of embodiments of the invention, including combinations of features from the various embodiments, use of other toner materials etc., will occur to persons of the art. The scope of the invention is thus limited only by the scope of the claims. The terms "comprise," "include," "have" or their conjugates, in the claims, mean "including but not necessarily limited to".

The invention claimed is:

1. A liquid toner imaging system having at least one metal product, in contact with liquid toner therein, said product having a coating having a thickness of between about 0.1 and about 2 micrometers thereon, said coating comprising anionic fluorosurfactant.

2. A system according to claim 1 wherein the coating comprises more than 50% by weight of said surfactant.

3. A liquid toner imaging system according to claim 1 when the fluorosurfactant includes chemical anchors to bond it to the metal surface.

4. A liquid toner imaging system according to claim 1 wherein the surfactant comprises a material having the formulation: $(RfCH_2CH_2O)_xP(O)(OH)_y$, where Rf=F $(CF_2CF_2)_z$; x=1 or 2; y=2 or 1; x+y=3; z=1 to about 7.

5. A liquid toner imaging system according to claim 1 wherein the surfactant comprises a material having the formulation: $RfCH_2CH_2SCH_2CH_2CO_2Li$, where Rf=F $(CF_2CF_2)_x$ and x=1 to about 9.

6. A liquid toner imaging system according to claim 1 wherein the surfactant comprises a material having the formulation: $(RfCH_2CH_2O)_xPO(ONH_4)_y$, where Rf= $(CF_2CF_2)_z$; x=1 or 2; y=2 or 1; x+y=3 and z=1 to about 7.

7. A liquid toner imaging system according to claim 1 wherein the surfactant comprises a material having the formulation: $(RfCH_2CH_2O)_xPO(ONH_4)_y$ where Rf=F $(CF_2CF_2)_z$ where x=1 or 2; y=or 1; and z=1 to about 7; x+y=4.

8. A liquid toner imaging system according to claim 1 wherein the metal is aluminum.

9. A liquid toner imaging system according to claim 1 wherein the thickness of the coating is greater than about 0.3 micrometers.

10. A liquid toner imaging system according to claim 9 wherein the thickness of the coating is greater tan about 0.5 micrometers.

11. A liquid toner imaging system according to claim 1 wherein the thickness is less then about 1 micrometer.

12. A liquid toner imaging system according to claim 1 wherein the metal product includes at least one surface that is not in continuous contact with the liquid toner.

13. A liquid toner imaging system according to claim 1 wherein the metal product has at least one surface that is in contact with liquid toner that is not subject to an electric field that would tend to plate toner particles onto the surface.

14. A liquid toner imaging system according to claim 13 wherein none of the coated surfaces of the metal product that are in contact with liquid toner are subjected to an electric field that would tend to plate toner particles onto the surface.

15. A liquid toner imaging system having at least one metal product, in contact with liquid toner therein, said product having a coating comprising an anionic fluorosurfactant in an amount greater than 50% by weight.

16. A liquid toner imaging system according to claim 15 wherein the coating comprises more than 80% by weight of said surfactant.

17. A liquid toner imaging system according to claim 16 wherein the coating comprises more than 90% by weight of said surfactant.

18. A liquid toner imaging system according to claim 17 wherein the coating comprises more than 95% by weight of said surfactant.

19. A liquid toner imaging system according to claim 18 wherein the coating comprises more than 99% by weight of said surfactant.

20. A liquid toner image system according to claim 15 wherein the fluorosurfactant include chemical anchors to bond it to the metal surface.

21. A liquid toner imaging system according to claim 15 wherein the surfactant comprises a material having the formulation: $(RfCH_2CH_2O)_x(O)(OH)_y$, where Rf=F $(CF_2CF_2)_z$; x=1 or 2; y=2 or 1; x+y=3; z=1 to about 7.

22. A liquid toner imaging system according to claim 15 wherein the surfactant comprises a material having the formulation: $RfCH_2CH_2SCH_2CH_2CO_2Li$, where Rf=F $(CF_2CF_2)_x$ and x=1 to about 9.

23. A liquid toner imaging system according to claim 15 wherein the surfactant comprises a material having the formulation: $(RfCH_2CH_2O)_xPO(ONH_4)_y$ where Rf=F $(CF_2CF_2)_z$; x=1 or 2; y=2 or 1; x+y=3 and z=1 to about 7.

24. A liquid toner imaging system according to claim 15 wherein the surfactant comprises a material having the formulation: $(RfCH_2CH_2O)_xPO(ONH_4)_y$, where Rf= $(CF_2CF_2)_z$ where x=1 or 2; y=2 or 1; and z=1 to about 7; x+y=3.

25. A liquid toner imaging system according to claim 15 wherein the metal is aluminum.

26. A liquid toner imaging system according to claim 15 wherein the metal product includes at least one surface that is not in continuous contact with the liquid toner.

27. A liquid toner imaging system according to claim 15 wherein the metal product has at least one surface that is in contact with liquid toner that is not subject o an electric field that would tend to plate toner particles onto the surface.

28. A liquid toner imaging system according to claim 27 wherein none of the coated surfaces of the metal product that are in contact with liquid toner are subjected to an electric field that would tend to plate toner particles onto the surface.

29. A liquid toner imaging system coated with a fluorosurfactant having chemical anchors to bond it to the metal surface.

* * * * *